US008182188B2

(12) United States Patent
Manico et al.

(10) Patent No.: US 8,182,188 B2
(45) Date of Patent: May 22, 2012

(54) BOOK AND A METHOD OF MAKING SAME

(75) Inventors: Joseph A. Manico, Rochester, NY (US); James M. Devoy, Rochester, NY (US); William Y. Fowlkes, Pittsford, NY (US); David J. Cornell, Scottsville, NY (US)

(73) Assignee: Eastman Kodak Company, Rochester, NY (US)

( * ) Notice: Subject to any disclaimer, the term of this patent is extended or adjusted under 35 U.S.C. 154(b) by 699 days.

(21) Appl. No.: 12/339,504

(22) Filed: Dec. 19, 2008

(65) Prior Publication Data

US 2010/0158637 A1 Jun. 24, 2010

(51) Int. Cl.
*B42C 11/00* (2006.01)
*B42C 9/00* (2006.01)

(52) U.S. Cl. ..... 412/5; 412/4; 412/8; 412/901

(58) Field of Classification Search ..... 412/4–8, 412/901; 281/40, 21.1, 29; 428/40.1, 41.8
See application file for complete search history.

(56) References Cited

U.S. PATENT DOCUMENTS

| | | | | |
|---|---|---|---|---|
| 3,210,093 | A * | 10/1965 | Steidinger | 281/21.1 |
| 4,184,218 | A * | 1/1980 | Hawkes | 412/8 |
| 5,632,842 | A * | 5/1997 | Oliver et al. | 156/268 |
| 5,716,181 | A | 2/1998 | Ebel | |
| 6,120,638 | A * | 9/2000 | Baxter et al. | 412/5 |
| 6,742,809 | B2 | 6/2004 | Frosig et al. | |
| 2004/0071918 | A1 * | 4/2004 | Cohen | 428/40.1 |
| 2008/0093836 | A1 | 4/2008 | Hoarau et al. | |

FOREIGN PATENT DOCUMENTS

GB 2316358 2/1998

* cited by examiner

*Primary Examiner* — Dana Ross
*Assistant Examiner* — Kyle Grabowski
(74) *Attorney, Agent, or Firm* — Eugene I. Shkurko

(57) ABSTRACT

An instant book binding system and book cover for rapidly binding single- or double-sided documents, photographs, pages, and other forms of hardcopy media into soft or hard cover books is disclosed. The book binding method using the book cover or system can be performed without special skills or training, and does not require the use of ancillary equipment. The book cover system can be used in conjunction with output on a wide variety of media types, finishes, and stock weights from any type of printer or copier, or with photographs. The finished books retain the appearance and function of conventional mass produced soft and hard covered books.

12 Claims, 16 Drawing Sheets

BOOK AND A METHOD OF MAKING SAME

CROSS-REFERENCE TO RELATED APPLICATIONS

This application is related to subject matter found in co-filed applications "BOOK COVER AND USES" to James M. Devoy et al., US Patent Publication No. 20100156085, and "INSTANT MEDIA BINDING SYSTEM" to Joseph Manico et al., US Patent Publication No. 20100158638.

FIELD OF THE INVENTION

The present invention relates to a system, apparatus, and method for constructing books using hard and soft book covers having an adhesive strip for binding media. The books can be made by an unskilled user to bind any media into a finished and functional book format.

BACKGROUND OF THE INVENTION

It is known to assemble books and photo albums from media of single- and double-sided printed documents and photographs. Traditional bookbinding methods included gluing and/or stitching a set of pages together along one edge. This bound edge was then attached to a book cover, either directly, or through attachment to a spine sheet. A spine sheet spanned the spine of the cover without being attached to it, and was adhered only to the two sides of the cover. The spine sheet allowed a user to fully open a finished book because it would flex separately from the spine of the cover. A hot glue method, traditionally an animal glue, or today a synthetic adhesive, typically binds the bound edges of the manuscript to the spine sheet or cover, and is used to bind the spine sheet to the cover.

Today there is a prolific variety of printing technologies, for example, traditional photographic, inkjet, electrophotographic, laser, hot wax transfer, thermal dye sublimation, and thermal ablation, in addition to traditional printing technologies of gravure, typeset, manual manuscript illustration, intaglio, woodcut, etching, stamping, in-mould printing, flexography, screen printing, and others, any of which can be used for home, retail, or commercial applications. Each one of these technologies produces its own range of printed output with different media types, stocks weights, sizes, formats, thicknesses, and surface finishes. Each also has different hygroscopic properties and chemical sensitivities, making binding of different media types together a technical challenge.

Today, more people print at home, or in a retail setting, such as in a grocery store, drug store, or specialty retailer. There is also a growing movement again in specialty, small-print presses. Such non-traditional book-makers, specialty presses and the home user, like to experiment with binding different types of materials together, and expect an easy-to-use process for binding materials.

Some commonly available binding systems for binding standard media types and sizes require modifying the media by perforating it to accommodate clamp- and ring-type binders. Alternatively, special media that is already perforated can be used. Clamp- and ring-type binders do not have the appearance and function of conventional soft or hard covered books. Further, a user has to ensure the perforations appear in the margins and do not obscure images or type on the media.

Many people now combine media to form scrapbooks centered around photographic images. Alternately, traditional photobooks are still desired by many. Different means of allowing the home user and retailer to easily assemble such books have been developed.

For example, the bindings system disclosed in U.S. Pat. No. 6,742,809 B2 "Photo Album Constructed From A Strip Of images," by Frosig et al., assigned to Eastman Kodak Company, shows how a continuous strip media format is used to form a set of pages for a photo album. The pages are interconnected by means of fan folding and adhesively binding a printed continuous media strip so that the pre-formed bundle will bond to a cover with a conventional pressure sensitive adhesive. Because there are no loose pages, individual pages can not become dislodged from the conventional pressure sensitive adhesive on the cover spine. In addition, the end sections of the adhesive covered continuous fan-folded strip can be used to attach to and reinforce front and back book covers, if desired, increasing the strength of the overall bond.

Many printers can not print on continuous strips of media and special formatting would be required for the information and/or images to be properly aligned with the fan folded pages. In addition, some printing technologies do not work well with adhesive coated media, which is required to attach the inner surfaces of the fan folded pages. Alternately, a user would have to apply the adhesive manually. In order to properly align and fold a continuous length of media, the media must be pre-scored, pre-creased, or pre-perforated in order to facilitate proper construction of the fan-folded page bundle. If a continuous length of media is not modified by the media manufacturer, equipment to perform these media modifications pre- or post-printing would be required by the user. Equipment of this type is readily available but requires time, user skill, and, if improperly used, can damage a finished print rendering it useless.

Another system for binding standard document types uses preformed hard or soft book covers with thermally activated adhesive pre-deposited along the inner surface of the book cover spine. This system requires binding equipment to apply heat and pressure to a special cover once the desired media is in place. The equipment clamps the media in place against the adhesive on the spine while it melts the adhesive. After the adhesive is melted, the bound book must be left to cool in order for the adhesive to set and adhere the pages to the cover spine. This method requires energy, heat, and significant time to produce the final product. In some systems, the cover and media must remain clamped during the cooling process. This method is not suitable for all media, for example, plastic sheets, thermal dye sublimation and electrophotography prints, and other prints sensitive to the high temperatures required to activate the thermal adhesive. This temperature sensitivity could result in damaged media or could affect the quality of the printing. In addition, once bonded, the solidified thermal adhesive lacks flexibility, which prevents the pages from laying flat and makes it difficult to hold the book open and turn the pages.

A supposedly more user-friendly system, US20080093836 A1, "Activation And Deactivation Mechanisms For Media Binders," by Hoarau et al., describes a clamp-type binder that provides a simple, equipment free, instant binding solution wherein the clamping mechanism is built into a preformed binder. The clamp is deployed by using the rigid book cover, bent backwards as a deployment lever, to open the clamp. The pages in this binder type are held in a tight bundle and can not lay flat. In addition, the binder must have a hard cover in order to act as a lever for the clamp, and does not maintain the appearance and function of a conventional book. However, this book allows removal and addition of pages by a user after formation.

U.S. Pat. No. 5,716,181 "A One Piece Self-binding System for Binding Documents," Ebel, like US20080093836 A1, discloses a pressure clamping mechanism built into the spine of a preformed binder. In this approach, however, a metal strip is used to keep the spring clamp opened until the media is placed in position. A pull ring is used to pull the strip free, allowing the clamp to close on the media. It is very difficult to re-open the clamp, making the book contents relatively permanent. U.S. Pat. No. 5,061,139 "Method for Applying Hard and Soft Covers to Bound or Unbound Documents," by Zoltner, describes a similar system where a U-shaped channel is bound into the spine of soft or hard covers, and the channel is crimped over the media to hold it in place.

Another known approach to providing a book binding system is demonstrated by GB2316358 A, "Album for adhesively binding a stack of pictures," by Paul Druckerei Kieser. This method is similar to conventional bookbinding methods. This system has a pressure sensitive adhesive coated on a flexible paper substrate that is attached to a book cover, as illustrated in FIGS. 1*a* and 1*b*. The adhesive photo print binding system 10 of Kieser has a cover 20 creased 60 at the edges of the spine 65 to allow the book cover 20 to open and close. The cover 20 has a flexible substrate 30 attached to the front and back inside edges of the cover 20 by an adhesive 50 over the spine 65, which is shown in more detail in inset 40, shown in FIG. 1*b*. The flexible substrate 30 is not attached to the book spine 65, and forms a floating spine section 90. A pressure sensitive adhesive 80 and an adhesive release layer (not shown) cover the flexible substrate in the area directly over the book cover spine, facing away from the book spine. A user must remove the release layer and expose the pressure sensitive adhesive to attach a stack of photographs 70 to the adhesive 80. The user must carefully align the stack of photographs with the adhesive before final placement. In addition the user must slide and press the external edge of the book spine across a sharp edge in order to set the pressure sensitive adhesive. This technique, along with the initial alignment process, both rely on the rigidity that a stack of heavy stock photographic media provides. The user must align and attach the stack of photographs to the exposed adhesive in a single action. Other less rigid medias, such a plain paper, would be difficult to align and push into the exposed adhesive as required. Once assembled, the flexible substrate deforms when the finished book is opened to compensate for stress on the page edge contact bond as the pages of the book are turned. Because the flexible substrate is not attached at the spine, the stress from the weight and movement of the pages is concentrated at the points where the flexible substrate is attached to the front and rear of the book cover. These stress point are prone to tearing. Further, because only the edges of the individual pages contact the thin layer of pressure sensitive adhesive, pages are prone to detach and fall out of the book.

There is a need in the industry of book making for a system, method and book whereby the book is easily assembled by an unskilled user using user-selected media, and wherein the book retains the media with sufficient force to prevent loss of media over time or during use.

SUMMARY OF THE INVENTION

A book and a method of forming the same is disclosed, wherein the book includes a book cover capable of accepting media. The book cover includes a front cover, a back cover, and a spine section therebetween, wherein an adhesive strip is adhered to the spine, with the side of the adhesive strip opposite the spine having a release strip removably attached. The adhesive strip has a peak load gram force per inch of at least 200 and a thickness of at least 0.1 mm. The book is formed by optionally attaching the adhesive strip if not already in place, assembling media for insertion, removing the release strip from the adhesive strip, and pressing the media into the adhesive strip. The resulting book can be opened such that adjacent pages can form an angle of at least 150 degrees.

ADVANTAGES

The system, method, and book cover described herein are easily understood and used by an ordinary person, without skill in the bookmaking industry. The assembled book provides a quality product that is neat, retains media over time and with extended use, and allows for fill viewing of each inserted media edge-to-edge. The system, method, and book cover can be used with various media, and can be used with mixed media, to form a permanent product.

BRIEF DESCRIPTION OF THE DRAWINGS

Throughout the specification, reference is made to the accompanying drawings.

The drawings are illustrative only, and are not to scale. Other embodiments and relations between the parts are envisioned, as explained in the Detailed Description.

DETAILED DESCRIPTION OF THE INVENTION

A book cover capable of accepting media, a system for forming a book, and a method of forming a book are described with reference to the Figures, which are exemplary only. Like numerals are used for like structures throughout the figures. As used herein, reference to a singular (for example, "cover," "strip," etc.) item or action are meant to also include the plural unless such an embodiment would be inoperative. Similarly, plural forms (for example, "covers," "strips," etc.) do not exclude use of a singular of the item or action.

The book cover can be of any media. Book covers are typically categorized as hard or soft covers, based on media choice. It can be desirable to choose a media that is wear resistant, such that the book cover will endure throughout extended handling, opening and closing, and exposure to various environmental conditions over time. Examples of materials include, but are not limited to, cardboard, paperboard, plastic, paper, any type of animal skin, metal, metallic coated materials, and fabric. The book cover can include a section for insertion of a photograph, paper, memento, or other object on the front cover. Book cover styles as are known for the printing industry, photographic albums, and specialty art book collections can all be used. The book cover, or at least a portion thereof can be printable by any means, for example, thermal printing, ink jet, laser printing, electrophotographic, or other methods, or writable.

The book cover can be the same dimensions as the media to be inserted. If it is desirable to have at least some of the media exposed, such as tabbed pages, when the book cover is closed, the book can be narrower than at least some of the media, shorter than at least some of the media, or both. To best protect the media, the book cover can be wider than all the media, longer than all the media, or a combination thereof.

The book cover can have a front cover and a back cover joined by a spine section. Typically, the front cover, back cover, and spine section are contiguous, made from a single sheet of material. However, the spine can be different from one or more of the front and back cover, and attached by any known means, including stitching, binding, gluing, stapling, or other methods, either directly or through an intermediary material that can form a spine crease, wherein the spine crease is a flexible section between the spine and front cover or back cover.

Figure 1A:
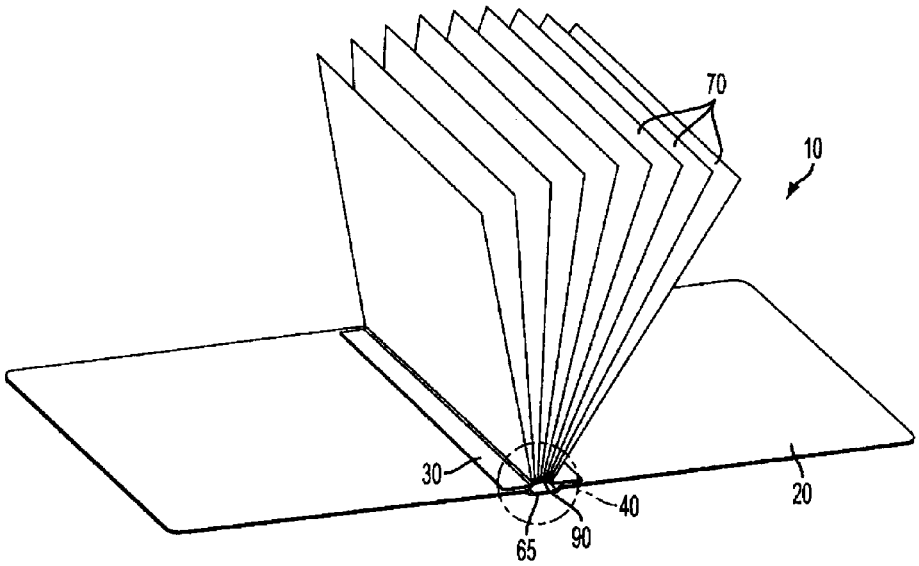
FIG. 1a PRIOR ART
FIG. 1*a* is plan view illustration of a prior art adhesive photo print binder.
Figure 1B:
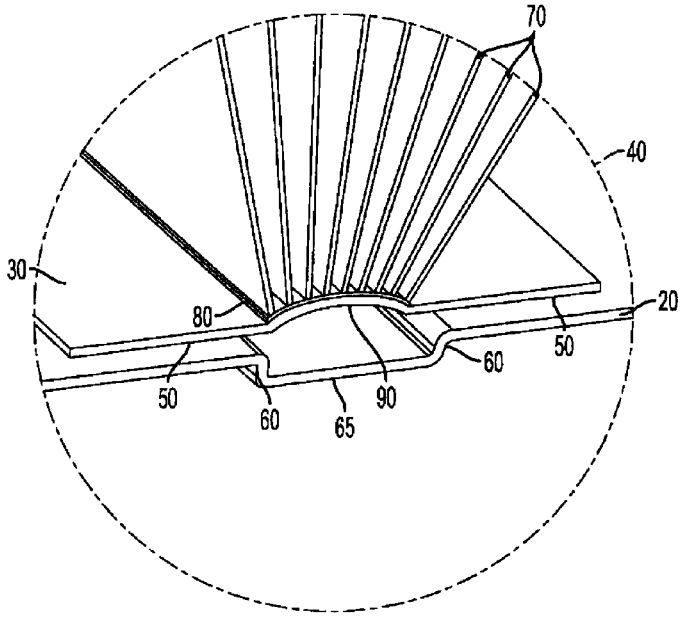
FIG. 1b PRIOR ART
FIG. 1*b* is close up plan view illustration of the spine section of the prior art adhesive photo print binder of 1*a;*
Figure 2A:
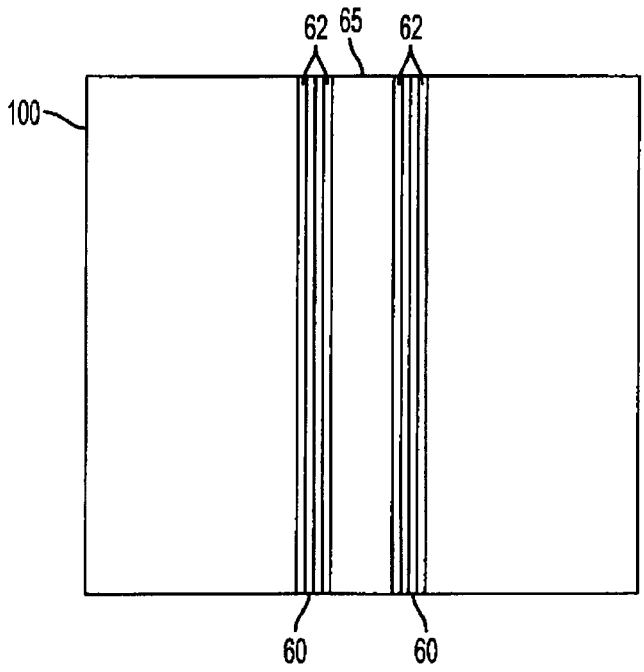
FIG. 2*a* is a plan view of a book cover with a selectable spine width section.
Figure 2B:
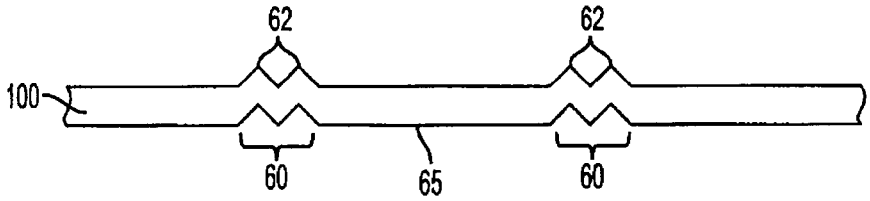
FIG. 2*b* is a side view of the book cover of FIG. 2*a;*

A book cover can have multiple pre-formed spine creases, or at least indicators of where a spine crease could be placed by a user in the spine section, as shown in FIGS. 2*a* and 2*b*. In FIGS. 2*a* and 2*b*, a book cover 100 has a spine section 65 with flexible spine creases 60 which are indicated to a user by spine crease indicators 62. This allows for user selection of the width of the spine section 65 to accommodate the fill collection of whatever media is being inserted into the book cover 100. Without a spine crease 65 selection, the appropriate book cover must be chosen to accommodate the width of the media to be inserted. The spine crease indicators 62 to select the width of the spine can include one or more crease, perforation, score mark, depression, line, or other visual or tactile indicator.

The entire spine section can be a very flexible material, or can include numerous pre-formed creases, perforations, score marks, or other means of increasing flexibility over the entire spine section. This enables the entire spine section to flex with the opening and closing of the book, the movement of pages, or both. If the entire spine section is flexible, any media inserted that is no thicker than the total width of the spine section can be used without the additional need to select a spine crease area, because the spine crease will naturally occur in a flexible spine section just beyond the media.

The book cover has an outside, viewable by the user when the cover is in a closed position, and an inside, viewable by the user when opened. On the inside of the spine section, the book cover can have one or more adhesive strip. A single adhesive strip can be used where there is a pre-defined, definite spine width. Alternately, multiple adhesive strips can be used to span the width, the height, or both of the spine. The adhesive strip(s) can be pre-attached to the book cover at the time of manufacture, or before sale. Alternately, the adhesive strip(s) can be attached by the purchaser (user), or at the retail location once the user has selected a book cover and adhesive.

The spine section can be flush or nearly flush with the book cover when the book cover is opened flat, or the spine section can extend from the front and back book cover section, forming a depression, channel, or tray-shaped spine section. The extended spine section can have two or more side portions, and a back portion, wherein the back portion can be flat or curved. An extended spine section allows for insertion of a thicker adhesive strip without concern for adhesion to the front and back book cover or spine creases, particularly where the adhesive strip is the full width of the spine section.

In alternative embodiments, a floating spine as known in the prior art can be used inside the cover over the spine section, and one or more adhesive strip can be attached to the inside of the floating spine for insertion of media. The floating spine is not necessary. Use of the floating spine with the adhesive strip provides a more secure insertion of the media into this pre-existing book cover format.

An adhesive strip is a piece of adhesive material suitably shaped to fit into the book cover spine section, and to hold the intended media for insertion. The term "strip" is not meant to imply any particular shape, as the adhesive material can be any geometric or irregular shape. The adhesive strip should have a thickness sufficient so that the media to be inserted in the book cover embeds into at least a portion of the adhesive strip. This enables better adhesion of the inserted media because more than the edge of the media is in contact with the adhesive strip. The media will have the edge and a portion of each side of the media in contact with the adhesive strip, increasing the adhesion force. For example, the adhesive strip can be at least 0.1 mm thick, although thinner adhesive strips may be acceptable if they allow embedding of the media. In some embodiments, the adhesive strip can be between 0.1 mm and 5 mm thick, although thicker or thinner adhesive strips can be used.

The adhesive strip can be sufficiently adhesive that an inserted medium can not be pulled from the adhesive. Also, the adhesive strip should not stretch significantly, for example, no more than three times its thickness. Excessive stretching can weaken the adhesive strip, and may allow the inserted media to be damaged. The adhesive strip can have a peak load gram force per inch of about 200 or greater. A lower peak load gram force per inch may be acceptable if other adhesive strip characteristics as described herein are met.

Examples of adhesive strips suitable for use herein include impregnated foamed adhesives, gel adhesives, and cast adhesive strips. The adhesive strip can be formed by casting into a tray or form, casting onto a release layer, or forming an open or closed cell foam from adhesive, or impregnating an open or closed cell foam with adhesive. Unlike conventional single- and double-sided tapes which have a thin coating of pressure sensitive adhesive affixed to one or two sides of a non-adhesive liner, or coated directly onto an adhesive release film, foamed, gel, and cast adhesives are adhesive throughout the thickness of the material. The adhesive material, once formed, has a release sheet on at least one side thereof, and the material is typically cut to shape for sheets, or rolled and slit to desired widths. Because these adhesive types do not include a supportive liner, and are flexible throughout the thickness of the adhesive material, they are more flexible and elastic than conventional single- and double-sided tapes. This allows the media for insertion to be embedded within the adhesive material, as opposed to being adhesively attached to only the surface layer, as with conventional single- and double-sided tapes. Embedding the media allows for secure media attachment while allowing the resultant book pages to move freely, and enables a lay-flat page presentation.

Gel, cast, and foamed adhesive strips have heretofore been used in such industries as pest removal for trapping of mice, rats and other vermin, and for attachment of heavy objects to walls or other surfaces, including rough surfaces such as stucco or brick, either inside or outside. Examples of specific adhesive strips include apeTape™ Adhesive Tapes (Essex, UK), such as JELLY® double-sided Very High Bond Tape and 3M 4905 VHB Double-Sided Tape Clear Acrylic Adhesive, and 3M™ SCOTCH® Exterior Mounting Tape 4011 and VHB™ Tapes, both adhesive and foam. Other adhesive strips having the characteristics described herein, whether commercially available or specialty products, can also be used.

Figure 3A:
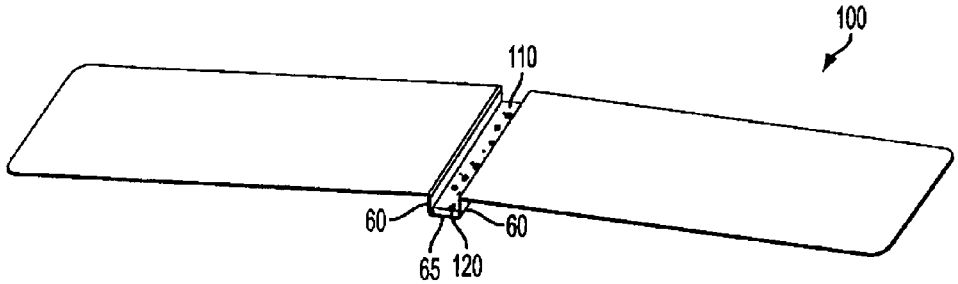
FIG. 3*a* is a plan view of a book cover and adhesive tray spine with gel adhesive according to one embodiment of the present invention.
Figure 3B:
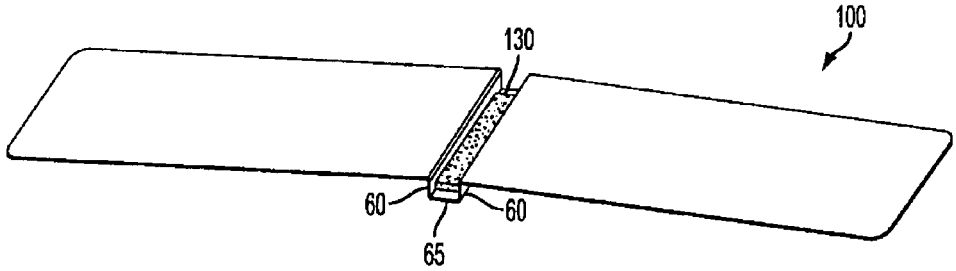
FIG. 3*b* is a plan view of a book cover with an adhesive impregnated foam strip according to another embodiment of the present invention.
Figure 3C:
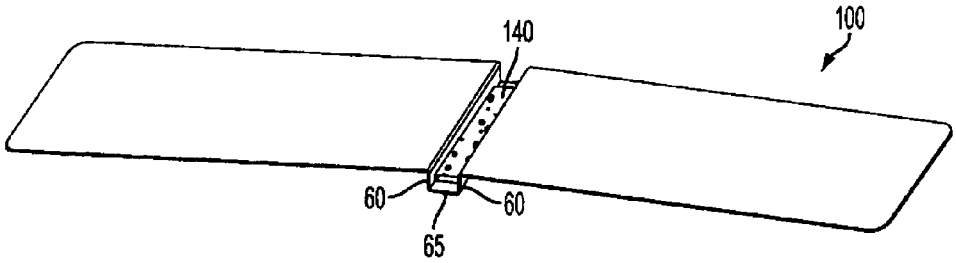
FIG. 3*c* is a plan view of a book cover with a cast gel adhesive strip according to another embodiment of the present invention.
Figure 3D:
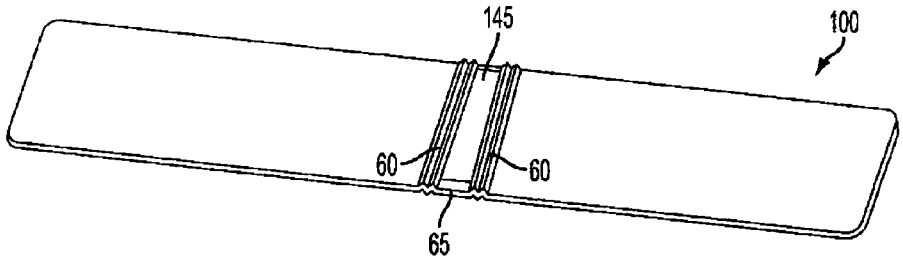
FIG. 3*d* is a plan view of a book cover with an adhesive strip in a flush spine section.
Figure 4A:
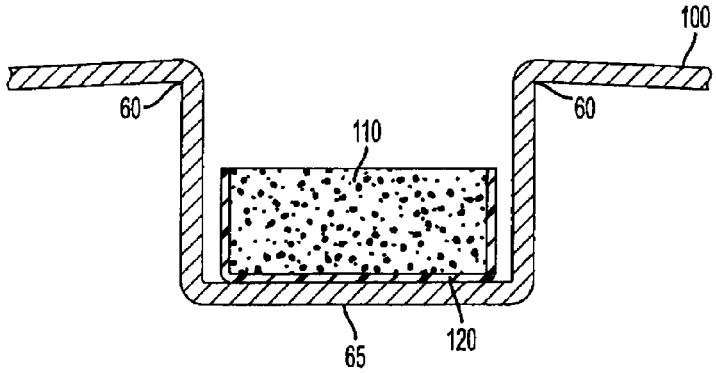
FIG. 4*a* is a sectional axial view of the book cover of FIG. 3*a;*
Figure 4B:
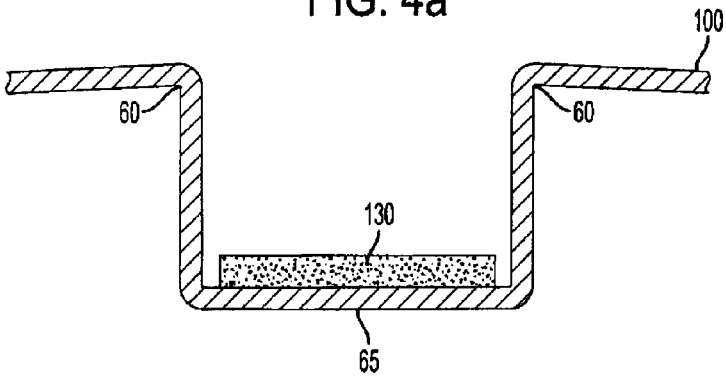
FIG. 4*b* is a sectional axial view of the book cover of FIG. 3*b;*
Figure 4C:
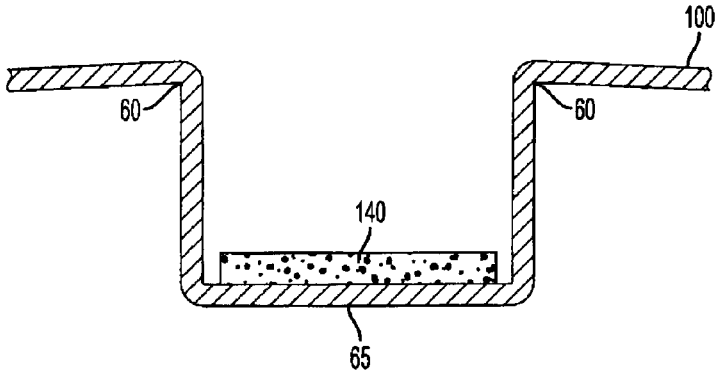
FIG. 4*c* is a sectional axial view of the book cover of FIG. 3*c;*
Figure 4D:
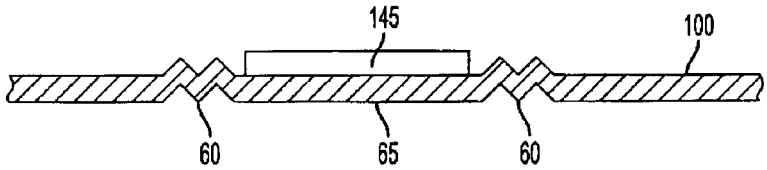
FIG. 4*d* is a sectional axial view of the book cover of FIG. 3*d;*

The adhesive does not need to be exactly as wide as the spine section of the book cover, and preferably is a little narrower, not extending into the flexible spine creases. This is exemplified in FIGS. 3*a-d* and 4*a-d*. FIGS. 3*a* and 4*a* are plan and side views, respectively, of a book cover 100 having a channel or tray-shaped spine section 65 bounded by spine creases 60, and having a gel adhesive 110 in a gel adhesive containment tray 120 in the spine section 65. FIGS. 3*b* and 4*b* are plan and side views, respectively, of a book cover 100 having a channel or tray-shaped spine section 65 bounded by spine creases 60, and having an adhesive impregnated foam strip 130 in the spine section 65. FIGS. 3*c* and 4*c* are plan and side views, respectively, of a book cover 100 having a channel or tray-shaped spine section 65 bounded by spine creases 60, and having a cast gel adhesive strip 140 in the spine section 65. FIGS. 3*d* and 4*d* are plan and side views, respectively, of a book cover 100 having a flush or nearly flush spine section 65 bounded by spine creases 60, and having an adhesive strip 145 in the spine section 65. Multiple adhesives strips can be used to substantially cover the spine section in width or length. The adhesive strip, or combination of multiple adhesive strips, should be as wide as, or slightly wider, and as long as, or slightly longer, than the media stack or bundle to be inserted, such that every medium in the bundle is embedded in the adhesive strip. Shorter adhesive strips can be used to ensure the adhesive strip is not exposed at the ends of the media stack in the book cover, if desired.

Figure 5A:
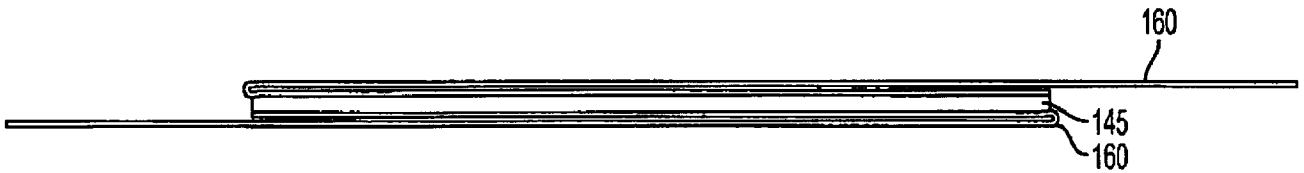
FIG. 5*a* is a side view of an adhesive strip with a top and bottom release strip.
Figure 5B:
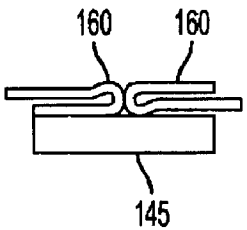
FIG. 5*b* is a side view of an adhesive strip with two release strips.
Figure 6A:
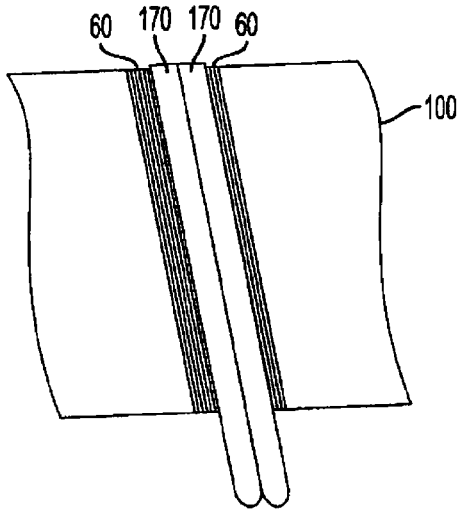
FIG. 6*a* is a plan view of a book cover with two adhesive strips side-by-side.
Figure 6B:
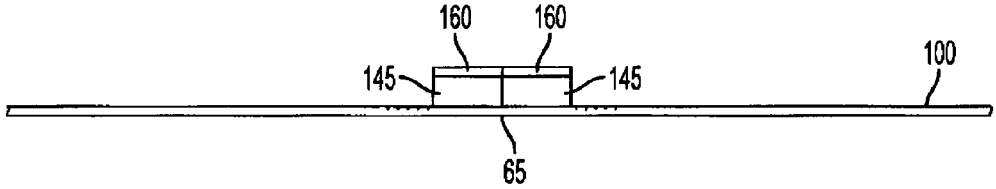
FIG. 6*b* is a side view of the book cover of FIG. 6*a;*
Figure 6C:
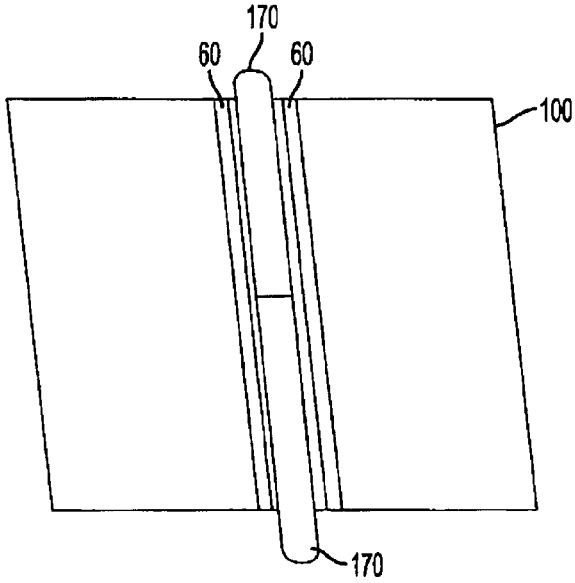
FIG. 6*c* is a plan view of a book cover with two adhesive strips end-to-end.

The adhesive strip can have one or more release strip attached thereto. The term "strip" does not imply a specific shape, and the release strip is a material releasably adhering to and cut to the relative shape of the adhesive strip. The release strip is removably attached to the adhesive strip, and is removed by a user to expose the adhesive strip for attachment to the book cover spine or the media for insertion. The release strip can slide easily along the media to be inserted. The release strip can slide easily along the spine of the book cover. The release strip desirably is very flexible, and has a low coefficient of friction, for example, of about 0.5 or lower, although a higher coefficient of friction may be acceptable in some circumstances, so long as the release strip can be removed from between the adhesive strip and either the spine section of the book cover or the media without tearing. The release strip can be longer than the adhesive strip, wider than the adhesive strip, extend beyond at least a portion of the adhesive strip, or some combination thereof. The extension of the release strip beyond the adhesive strip enables the user to grasp the release strip easily for removal from the adhesive strip. The portion of the release strip extending beyond the adhesive strip can be a doubled-over portion of the release strip, wherein the release strip is folded into a V-shape, with one arm of the V-shape extending beyond the adhesive strip. The V-shape configuration of the release strip allows the release strip to be removed from the adhesive strip with a low pull force because the direction of pull is close to 180 degrees as the release strip is pulled from between the adhesive strip and the media, or from between the adhesive strip and the book cover spine. This is demonstrated in FIG. 5*a*, wherein adhesive strip 145 has a top and a bottom release strip 160, wherein each release strip 160 extends along the full length of adhesive strip 145, then doubles back for the full length of the adhesive strip 145 and release strip section attached to the adhesive strip 160, and extends beyond the adhesive strip 160 to form a pull tab.

Where the book cover spine and/or media for insertion is long, or wide, multiple release strips can be used to expose only a portion of the adhesive strip at a time. For example, as shown in FIG. 5*b*, two release strips 160 can be placed on a single adhesive strip 145, wherein the release strips 160 each are V-folded, and the V-folded portions of each release strip 160 abut, resulting in a pullable release strip section on either end of the adhesive strip 145. Removing shorter lengths of release strip can make it easier for a user to hold the media in place with respect to the adhesive strip, or the adhesive strip in place with respect to the book cover spine, with one hand, and remove the release strip with the other hand. Book covers with multiple attached adhesive and release strips are exemplified in FIGS. 6*a-c*. FIGS. 6*a* and 6 are plan and side views, respectively, of a book cover 100 having spine section 65 bounded by spine creases 60. As shown in plan view FIG. 6*a*, two adhesive strips with attached release strips 170 are located side-by side between the spine creases 60. As shown in corresponding side view FIG. 6*b*, the two adhesive strips 145 with attached release strips 160 (collectively indicated in 5*a* as 170), are situated in the spine section 65 bounded by spine creases 60. FIG. 6*c* is plan view of a book cover 100 having two adhesive strips with attached release strips 170 laid end-to-end along the length of the spine section bounded by the spine creases 60.

Once removed, the one or more release strip can be retained, for example, as a bookmark. The release strip can be printed, embossed, or otherwise marked with indicia, for example, text, graphics, or figures, indicating how to remove the release strip from the adhesive strip. The release strip can be printed, embossed, or otherwise marked with indicia, for example, for special occasions, for example, a birthday, anniversary, graduation, or holiday, peoples names, images, decorative scenes, or graphic designs. The release strip can be one or more colors. The release strip can be a different color than the adhesive strip for easy identification of the adhesive strip versus the release strip.

The book cover and adhesive strip can be provided as a system or kit for use in binding media into book form. The book cover can be provided with a single width spine section and pre-adhered adhesive strip having one or more release strip for insertion of the media.

The book cover can have indicia for multiple spine creases. Where a choice of spine section width is so provided, the book cover can include a single, pre-attached adhesive strip with a release layer. Alternately, the book cover with selectable spine section width can have multiple, pre-attached adhesive strips each having at least one of its own release layer so that only the needed adhesive strip(s) can be exposed to match the selected spine section width. In such a configuration, there may be a main, wider adhesive strip, and additional narrow adhesive strips adjacent the main adhesive strip, wherein each narrow adhesive strip corresponds to an additional spine section width.

The book cover can be chosen from a selection. If the adhesive is provided separately, it can also be chosen to match the width of the selected book cover spine section, to provide indicia as desired on the release strip, or a combination thereof.

A system or kit can include a single book cover and multiple adhesive strips of varying dimensions so the user can select the appropriately dimensioned adhesive strip for the spine section width as determined by the media to be inserted. Alternately, a system or kit can be provided with multiple book covers, and multiple adhesive strips, wherein more adhesive strips than book covers are provided, again to allow the user proper matching of the book cover spine section width and adhesive strip to the media bundle to be inserted.

Where adhesive strips are provided separately, they can have a release strip on at least two sides, a first side to face the book cover spine section, and a second side to face the media for insertion. The release strips can be the same or different in appearance. For example, the release strip to face the media insertion side could be decorative, while the release strip for the book cover spine section side is plain in appearance. If an adhesive strip is particularly thick, side release strips may also be provided if the sides of the adhesive strip are tacky. The sides can be adhered to a portion of the spine section, but preferentially do not interfere with the spine crease so that flexibility of the book cover is maintained. This can be accomplished, for example, where the book cover spine section is a channel, the upper edges of the channel forming the flexible crease that allow movement of the front and back portions of the book cover.

The system or kit can include decorative items for addition to the book cover or media as desired. For example, the system or kit can include stickers of images, text, or graphics, decorative writing materials for use on the book cover or media, sparkles, stars, or other materials. The system or kit can also include blank or pre-decorated media, attachable page tabs, separator pages with or without tabs, or other media forms.

The system or kit can include a coating powder for covering the adhesive strip once the media is inserted. Once the release strip is removed, and the adhesive strip is adhered to the book cover spine section and the media is inserted in the adhesive strip, portions of the adhesive strip may remain exposed. Due to the tackiness of the adhesive strip, it may be desirable to coat the exposed areas of the adhesive strip with a substance to eliminate the remaining tacky or sticky surfaces wherever possible. Any suitable inert coating material can be used, for example, but not limited to, chalk, talcum powder, silica beads, glass beads, colored dust particles, paper fiber, glitter, or sparkles. The coating material can be supplied in a solid form, such as a pencil, chalk, or solid stick. The coating material can be supplied as a powder in a dispenser, for example, in a sealed container such as an envelope, box, or canister. The coating material can be supplied in an aerolized or aerolizable form, for example but not limited to a squeeze bulb, pump bottle, or aerosol. The coating material can be any color. For example, the coating material can be transparent, the same color as the adhesive strip, the same color as the media, the same color as the book cover, or any decorative color or colors desirable, including metallic. A choice of coating materials could be provided when the book cover system or kit is purchased by a user, or a selection of coating materials can be provided in the system or kit at the time of purchase.

The system or kit can include one or more media clamp. The function of a media clamp is to aid the user in pinching the media together to form a tight media stack or bundle for insertion into the adhesive strip in the book cover spine section. The media clamp can be any item suitable for this purpose. For example, one or more a paper clip, binder clip. alligator clip, or other vise-like or clamp-like device can be provided or used to force the media into a tighter bundle. Two separate pieces may also form a media clamp, wherein one piece is held on each side of the media, and the user exerts force on the two pieces towards one another (squeezes) to force the media together. Preferably, a media clamp, whether of one or two pieces, has a sufficient width to distribute its force over an area of the media. Use of the media clamp near the edges of the media for insertion in the adhesive strip can also result in the media edges flaring slightly, separating each medium from the adjacent medium and allowing maximum insertion of each medium in the bundle or stack into the adhesive strip. The use of the media clamp also imparts further rigidity to the insertion media bundle, allowing for deeper penetration into the adhesive strip.

The media clamp, if in two or more pieces, can be formed as part of the book cover. For example, a raised section can be formed on the inside of the front and back inside portions of the book cover near the spine section. These media clamps could be removable after use. For example, they could be affixed to the book cover by Velcro or removable adhesive, or clipped or clamped over the book cover edges, for removal once the media has been inserted into the adhesive strip. Alternately, the book cover itself can function as a media clamp if the media bundle for insertion is sufficiently thick, or the book cover is formed with appropriate internal raised sections, ridges, or curvatures.

The media for use with the book cover and adhesive strip described herein can be any media that has sufficient stiffness to penetrate the adhesive. The required stiffness can result from being held in a bundle by the user or a media clamp. Deep penetration of the adhesive strip is not required. Penetration sufficient to allow the adhesive strip to bind to a portion of the front and back surface of a medium, as well as the edge, is desired for maximum hold. The penetration should be sufficient so each inserted medium does not come separate from the adhesive strip in normal use (turning of media pages in the book cover). The penetration should be sufficient so individual medium can have force exerted along the medium in a direction away from and perpendicular to the adhesive strip, and the medium will extend with the adhesive strip, but not separate therefrom, at least to the point the adhesive strip reaches a maximum elongation at break. The elongation at break can be, for example, about 300% the thickness of the adhesive strip at room temperature. Adhesives with shorter or longer elongation at break maximums are possible and can be used. Longer maximums can allow for excessive stretching of the media from the book cover, which can result in damage to the media. Shorter maximums may not allow enough give for normal usage. However, the elongation at break is merely one of several properties of an adhesive to consider, the other properties being discussed elsewhere herein.

Media suitable for insertion can include, but are not limited to, natural and synthetic papers; synthetic sheets such but not limited to as plastic, mylar, or vinyl; cardboard and other paper or pulp materials; stiff fabrics; reinforced fabrics; mixed media sheets; photographs; metal sheets; glass plates; and other sheet-like materials. Any medium that has sufficient stiffness to penetrate the adhesive, is not too heavy for the adhesive to retain, and is of desirable dimensions and stiffness to please the user is acceptable. The medium must be light enough to not exceed the adhesive or cohesive strength of the adhesive strip. This can be tested by insertion of the desired number of such media into an adhesive strip attached to a book cover, and determining if the media can be easily removed by an upward pull (the orientation a user would normally have relative to the adhesive strip) away from the book cover, or if holding the book cover so the adhesive strip and media face downward allows the media to work free of the adhesive strip or separates the adhesive strip from the book cover.

Media inserted into a book cover can be all the same medium, or different mediums. Each medium independently can be decorative, plain, mixed media, or have attachments thereto. Commercially available media such as photobook pages, templates, and framing pages (for example, of paper, paperboard, cardboard), can be used. A medium can have a V-fold shape, such that the edge for insertion is the V-folded edge, the free edges forming the edges of the pages for turning in the book cover. Pop-up pages, and pages with extension section that open out from the book cover can also be used.

Figure 7A:
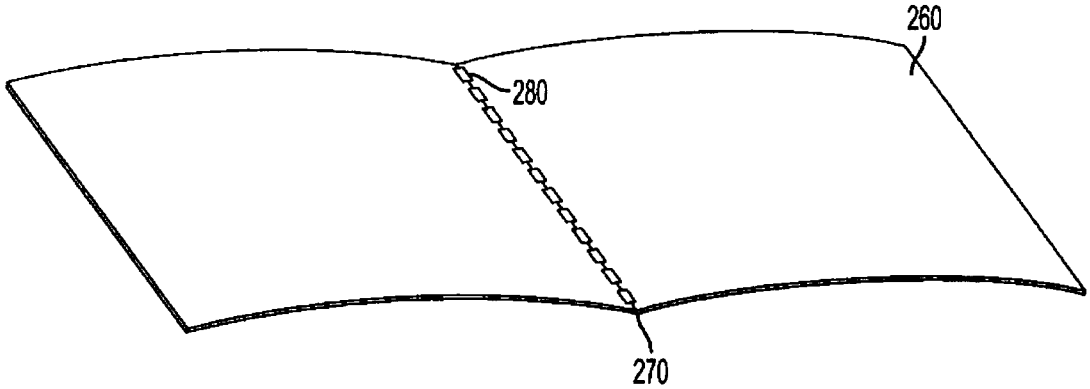
FIG. 7*a* is a plan view of a V-folded page with optional perforations on the fold line.
Figure 7B:
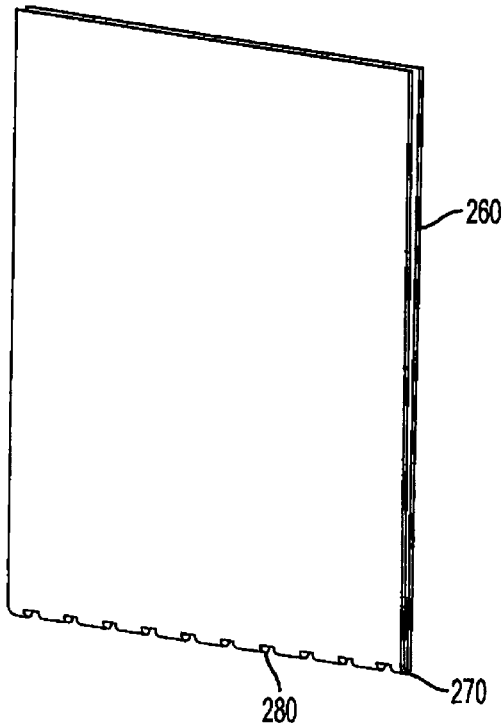
FIG. 7*b* is a plan view of the V-folded page of FIG. 7*a* with the pages closed.
Figure 8:
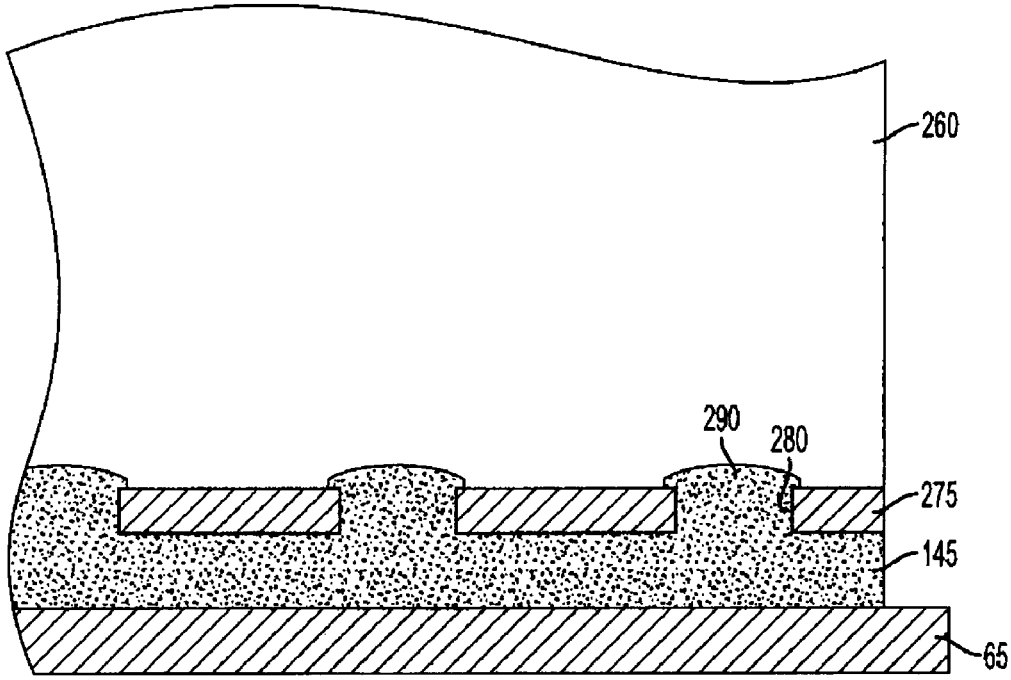
FIG. 8 is a side view illustrating adhesive perforation of a perforated medium.

To maximize adhesion of the media to the adhesive strip, the edge of a medium for insertion can be uneven. For example, the edge for insertion can be roughened, frayed, perforated, regularly or irregularly cut, or otherwise made to have an increased surface area to promote adhesion. Rough edges provide more surface area, and can allow more wicking of the adhesive strip material around each medium, for maximum adhesion. A V-folded page set 260 of perforated media is shown in FIGS. 7*a* and 7*b*. The V-folded page set 260 has a center crease 270 with perforations 280. The V-folded page set 260 can be inserted into an adhesive strip 145 in the spine section 65 of a cover such that an adhesive protrusion 290 forms between the media portions of the perforations 275 of the perforated V-folded page set 260, as shown in FIG. 8. The adhesive protrusions 290 increase the adhesive bond between the adhesive strip 145 and the V-folded page set 260 by increasing the surface area of the V-folded page set 260 in contact with the adhesive strip 145.

The media could be provided with the book cover system or kit in a size and amount appropriate to fill the accompanying binder. The prepared media stack provided with the book cover could be selected from media appropriate with commonly found home printers, for example, but not limited to, ink jet media, laser printer media, dot matrix media, and thermal receiver media, possibly including a thermal donor media kit appropriately sized to the receiver media stack as well. Kits for use by commercial stores, such as, for example, craft stores, pharmacies, printers, copiers, and general retail stores with imaging departments, where the store can fulfill a text, photographic, or combination print order, can include the above typical media types, or media appropriate for electrophotographic printers, high speed ink jet printers, lithographic printers, photographic printers, or any other printer type. The prepared media stack could also be provided or sold with an indicator of the appropriate book cover(s) for which it can be used. Such an indicator could include a serial or stock number of the book cover; book cover dimensions including height, width, and thickness; book cover reference style names; or any other known corresponding coding method. This allows a user or commercial establishment to choose the appropriate media type for the printer to be used. Further, the prepared media kit could be sold with the appropriate sized toner, donor media, ink, paint, or other marking material sufficient to print all the sheets in the media bundle with the desired printing method.

It is noted that roll fed media can be used, but must be cut prior to insertion into the book cover, or folded such that the edges can be cut to form pages after insertion in the book cover. Perforated roll media can be used in alternate folds without precutting because the adhesive strip will wick through the perforations onto either side of the media. If the adhesive strip is sufficiently tacky or sticky, one or more prestitched, prestapled, or otherwise preformed V- or nested-stack of media could be inserted into the adhesive strip in the book cover.

To use the material described herein, a user will first purchase a system or kit, or select the independent material of a book cover and adhesive strip. The selection of the book cover should be made with the maximum spine section width in mind, which spine section width should be wider than the media stack intended to be inserted into the book cover. It is desirable that the spine width be at least slightly wider than the media stack, but the widths can be identical, or the media stack can be significantly narrower than the spine width if desired.

If the book cover has multiple possible spine widths, a user can select the appropriate spine width and then flex the book cover to create the spine creases in the correct positions to define the appropriate spine width.

If the adhesive strip(s) is not pre-adhered to the spine section of the book cover, a user can position the adhesive strip(s) within the spine section as needed, and remove the release strip between the adhesive strip(s) and the book cover spine section while holding the adhesive strip(s) in position. The adhesive strip(s) can then be firmly pressed against the spine section of the book cover to ensure adhesion. The adhesive strip(s) on the spine section can be pressed with or into a surface, for example, using a finger, a ruler, book, block of wood, along a table or table edge, to ensure adhesion to the spine section for the full width and length of the adhesive strip.

Once a book cover with an attached adhesive strip(s) is in hand, a user will collect the desired media to form the media bundle for insertion. The media should be stacked, with at least one edge of all media aligned. If two or more V-fold shaped media are used, the V-fold edges are aligned in the stack. The V-fold shaped media are not stacked or nested within each other, but can be adjacent one another in a stack, or separated by non-V-fold shaped media. Each medium must independently be in contact with the adhesive strip.

Figure 9A:
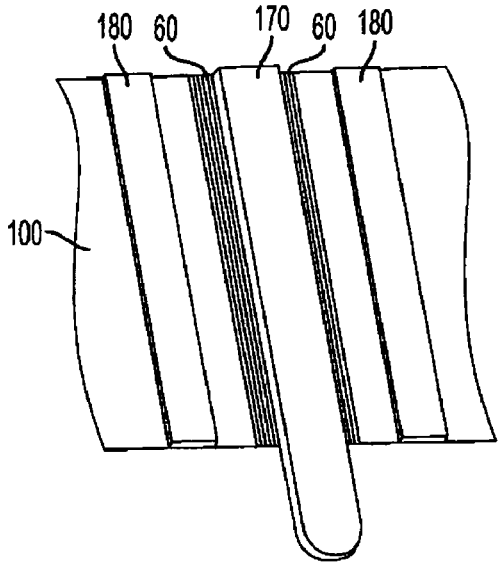
FIG. 9*a* is a plan view of a book cover with optional media clamps.
Figure 9B:
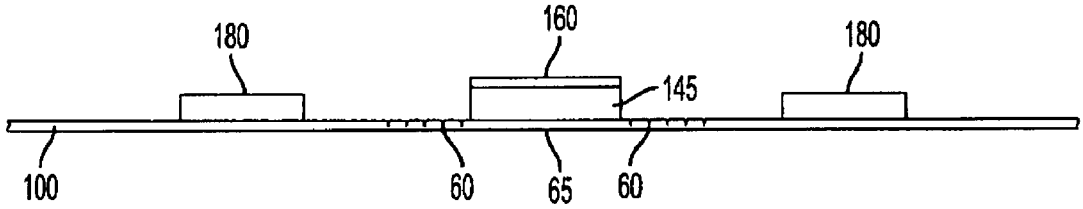
FIG. 9*b* is a side view of the book cover of FIG. 9*a;*

Once the media is stacked, a media clamp optionally can be applied to compress the media into a tighter bundle. Use of the media clamp on the bottom third of the media towards the aligned edges, but not at the aligned edges, can cause the aligned edges to flare, separating them from each other and allowing better adhesion of each medium to the adhesive strip. The media clamp can be formed as part of the book cover, as shown, for example, in FIGS. 9*a* and 9*b*. FIGS. 9*a* and 9*b* are a plan view and side view, respectively, of a book cover 100 having an adhesive strip 145 with attached release strip 160, collectively 170, between spine creases 60, and media clamps 180 on either side of the spine section.

Figure 10A:
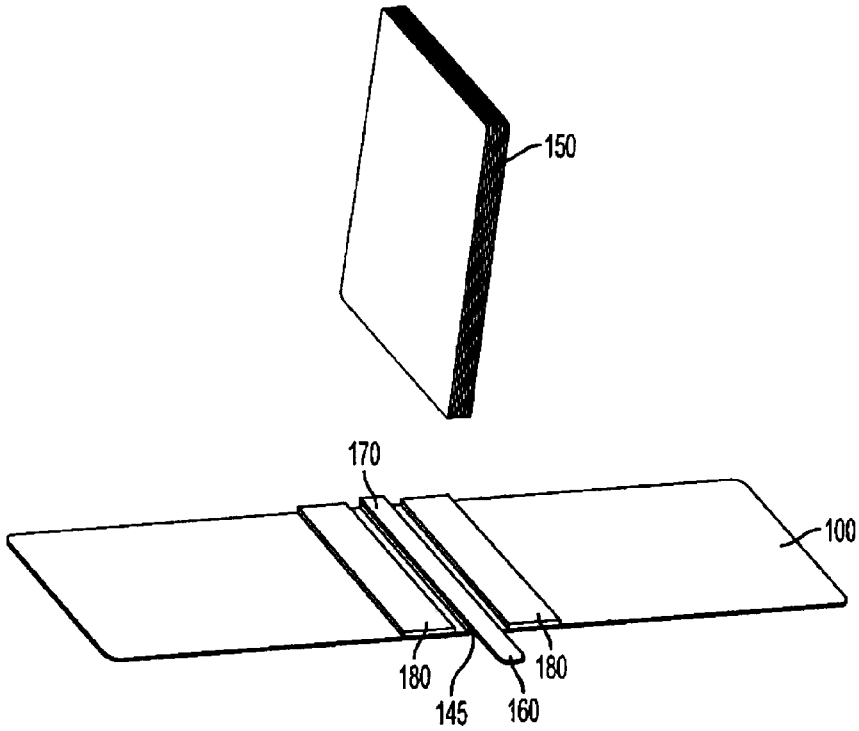
FIG. 10*a* is a plan view of a book cover and an unattached media bundle.
Figure 10B:
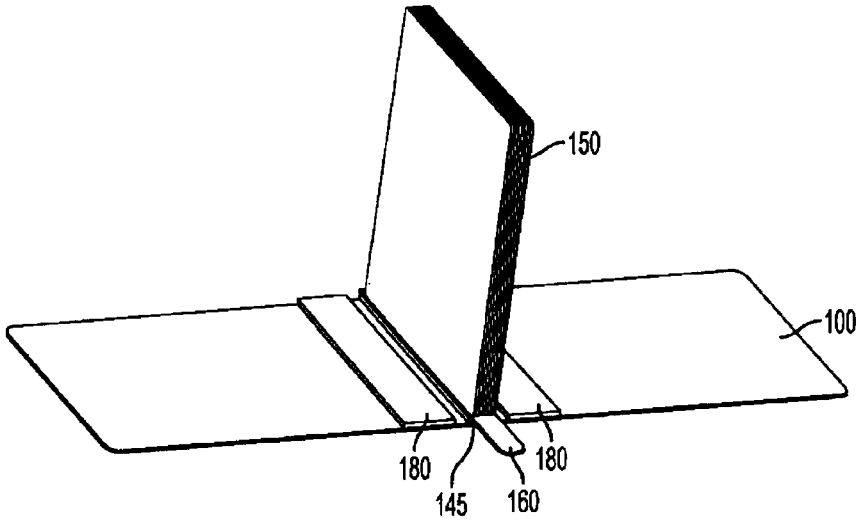
FIG. 10*b* is a plan view of a book cover with a media bundle in place against the adhesive strip with attached release strip.

As shown in FIGS. 10*a* and 10*b*, the aligned edge of the media bundle 150 is positioned on the adhesive strip 145 with attached release strip 160 (collectively 170), with application of a firm downward force. The media bundle 150 can be horizontally and vertically centered on the adhesive strip 145 for a symmetrical appearance, however alternate placement is possible as desired by a user. As shown in FIG. 11*a* and close-up FIG. 11*b*, the media bundle 150, with or without use of a media clamp 180, should be slightly compressed above the aligned edges for insertion. Preferably, the release strip facing the media bundle is removed after the media bundle is positioned and held into place against the release strip on the adhesive strip. The release strip could be removed before positioning of the media bundle, however once a medium has adhered to the adhesive strip, it will not be repositionable, so greater care is necessary if the release strip is removed before positioning the media bundle. As the release strip is removed, the media bundle will embed into the adhesive strip. If a media clamp was used, it is now removed from the media bundle.

Figure 11:
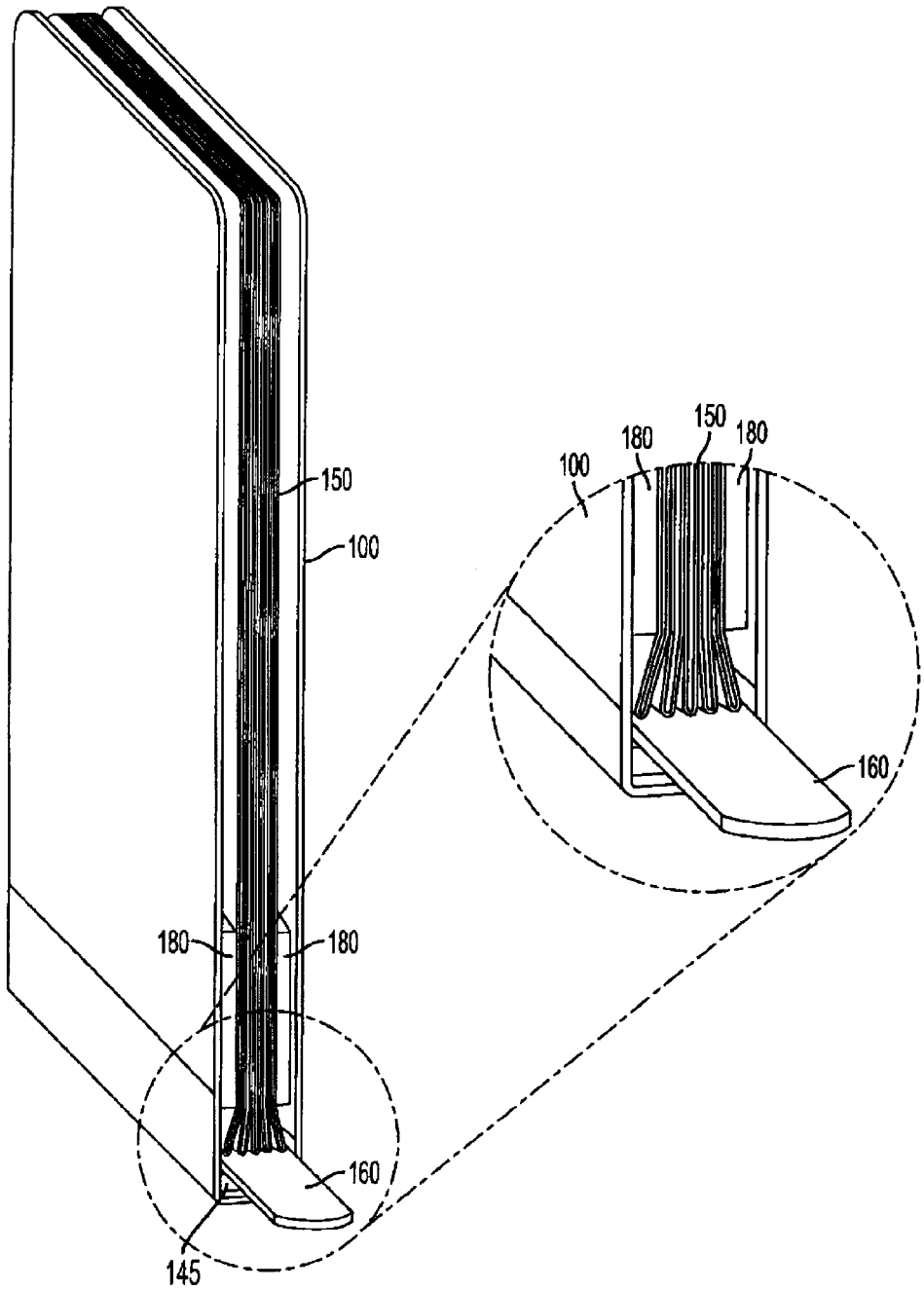
FIG. 11 is a plan view of a closed book cover with media clamps and inserted media bundle.
Figure 12:
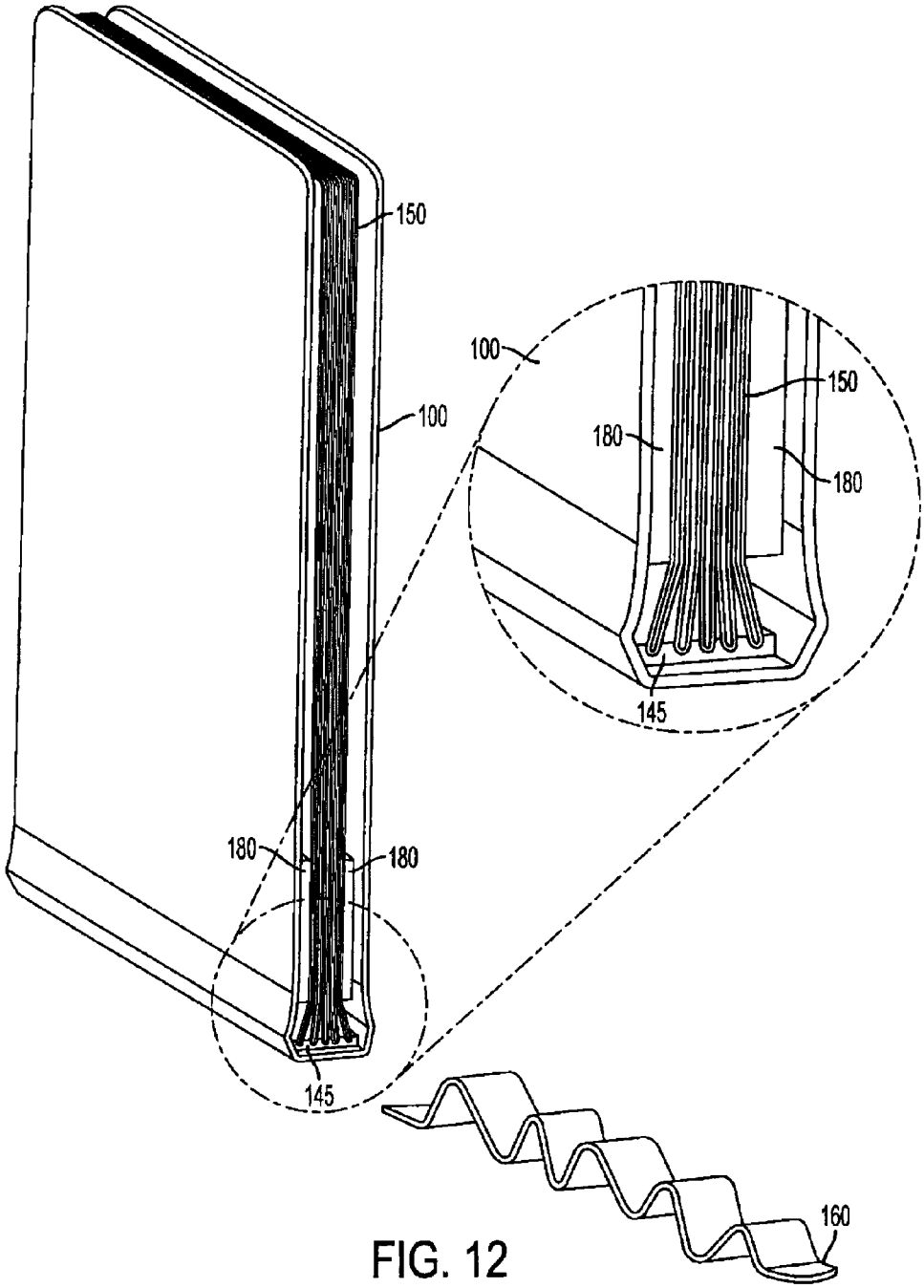
FIG. 12 is a plan view of a closed book cover with media clamps and the removed release strip.
Figure 13A:
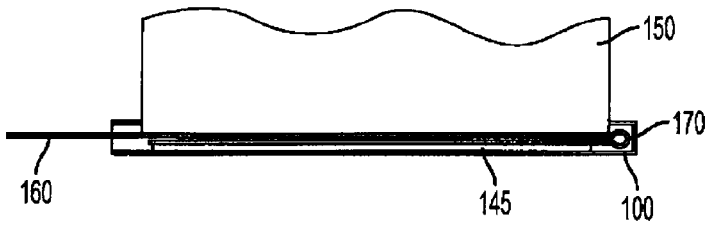
FIG. 13*a* is a sectional side view of a book cover and an unattached media bundle against the adhesive strip with attached release strip.
Figure 13B:
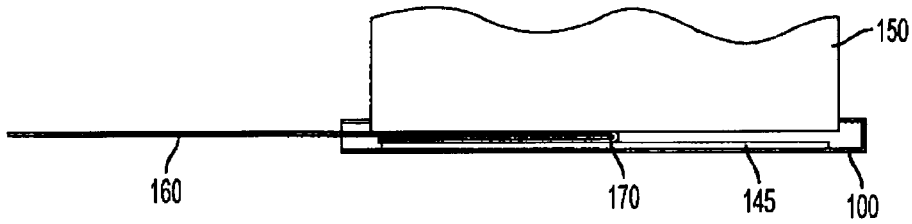
FIG. 13*b* is a sectional side view of a book cover with a media bundle in place and the release strip partially removed, exposing part of the adhesive strip.
Figure 13C:
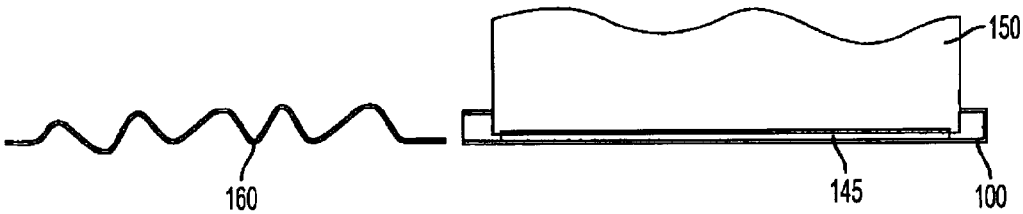
FIG. 13*c* is a sectional side view of a book cover with the release strip removed, and the media bundle adhered to the adhesive strip.
Figure 14:
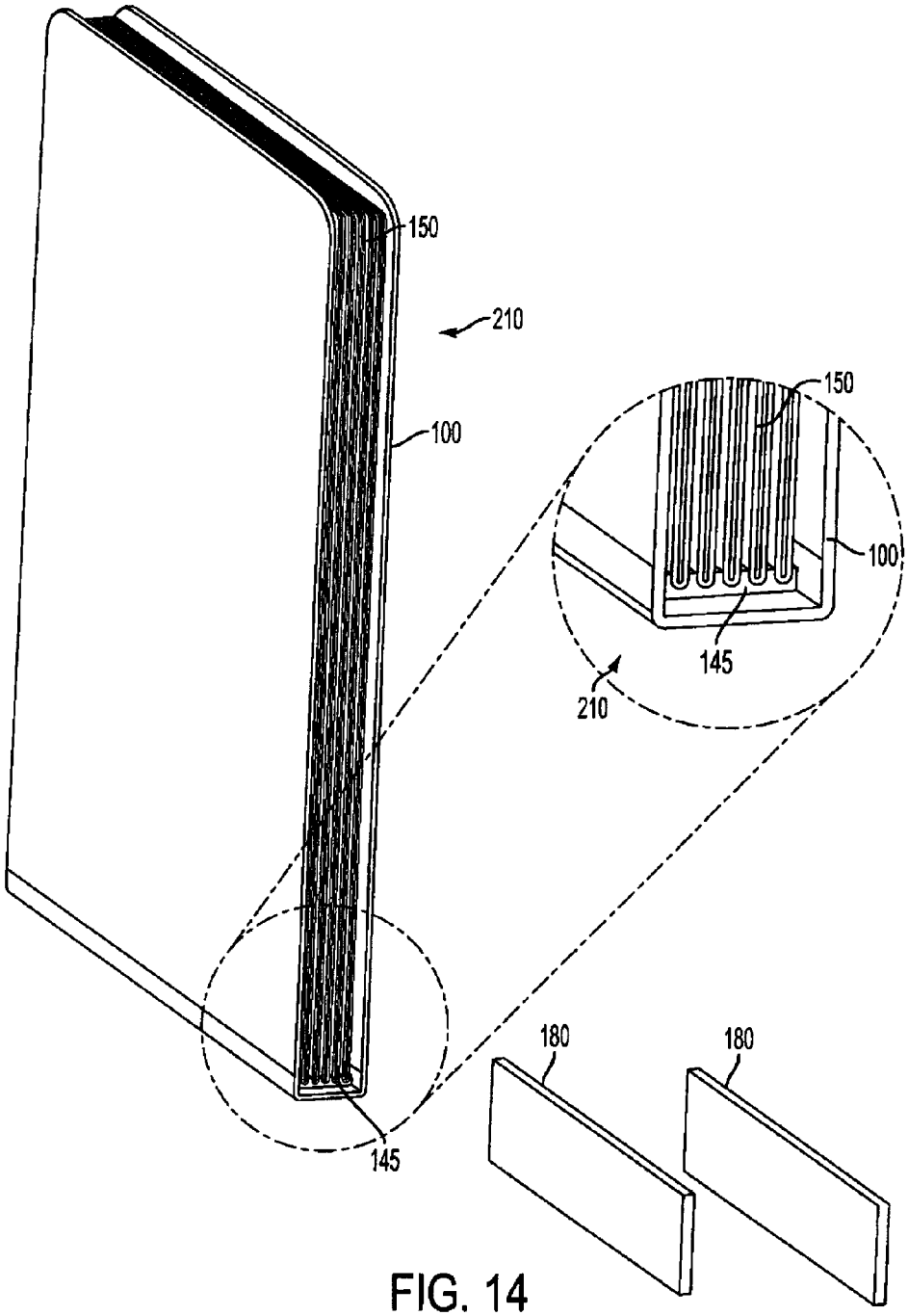
FIG. 14 is a plan view of a closed book cover with an attached media bundle and removed media clamps.

If the media clamp is part of the book cover, or removably attached thereto, the media is aligned, positioned against the release strip on the adhesive strip, and the book cover is closed against the media, as shown in FIGS. 10*a-b* and 11, holding the media bundle 150 in place and compressing the media at least where the media clamps 180 are positioned within the book cover 100. As shown in the call-out of FIG. 11, the media clamps 180 compress the media bundle 150 such that the ends of the media within the bundle fan outwards, creating space between each medium in the bundle as they are located on top of the release strip 160. As shown in FIG. 12, the release strip 160 is then removed, allowing contact between the media bundle 150 and the adhesive strip 145. As shown in FIG. 12, because the media clamps 180 are still in place, the media bundle 150 still appears flared within the adhesive strip 145. FIGS. 13*a-c* show a side view of the removal of release strip 160 from adhesive strip 145. FIG. 13*a* shows the release strip 160 adheres to the adhesive strip 145 as a unit 170, with media bundle 150 pressed against the release strip 160. FIG. 13*b* shows the release strip 160 partially removed from the adhesive strip 145. FIG. 13*c* shows the release strip 160 completely removed from the adhesive strip 145, such that media bundle 150 is directly in contact with adhesive strip 145. It is noted the book cover itself can function as a media clamp, particularly where a media bundle is nearly equivalent in width to the spine section of the book cover. Once the media bundle 150 is in contact with the adhesive strip 145, the media clamps 180 optionally can be removed, allowing the media within the media bundle 150 to return to an uncompressed state, resulting in a finished book 210, as shown in FIG. 14 and the call-out therein.

Figure 15:
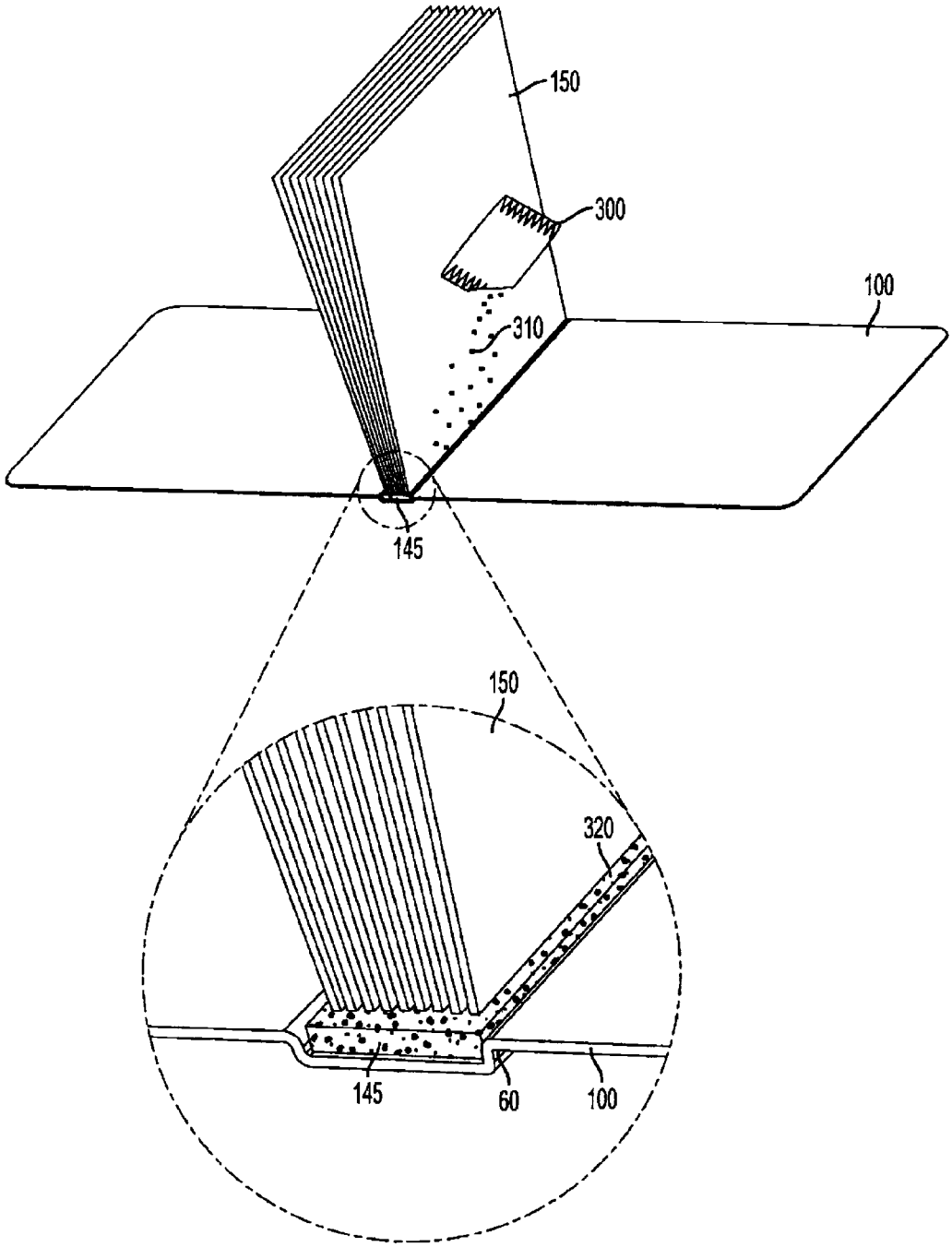
FIG. 15 is a plan view of application of a coating material to the adhesive strip of a finished book.

Optionally, once the media bundle is embedded in the adhesive strip, a coating material 310 can be applied to the adhesive strip 145 to cover all remaining surfaces, such that no tacky or sticky surfaces of the adhesive strip remain, as shown in FIG. 15, wherein the coating-covered adhesive 320 has little or no tackiness to the surface. The coating material can be applied by any means, for example but not limited to, rubbing, sprinkling, pouring, brushing, or blowing the coating material onto the adhesive strip. As shown in FIG. 15, the coating material 310 can be supplied in a packet 300, a container, pre-coated on a brush or swab, or in any other suitable format. The edges of the adhesive strip beyond the media bundle can be coated. If desired, the pages in the media bundle can be separated and coating material applied between the pages at the adhesive strip as well. Excess coating material can be removed by any suitable method, for example but limited to, wiping, blowing, brushing, or shaking excess coating material from the adhesive strip, pages of the media bundle, book cover, or some combination thereof.

Figure 16:
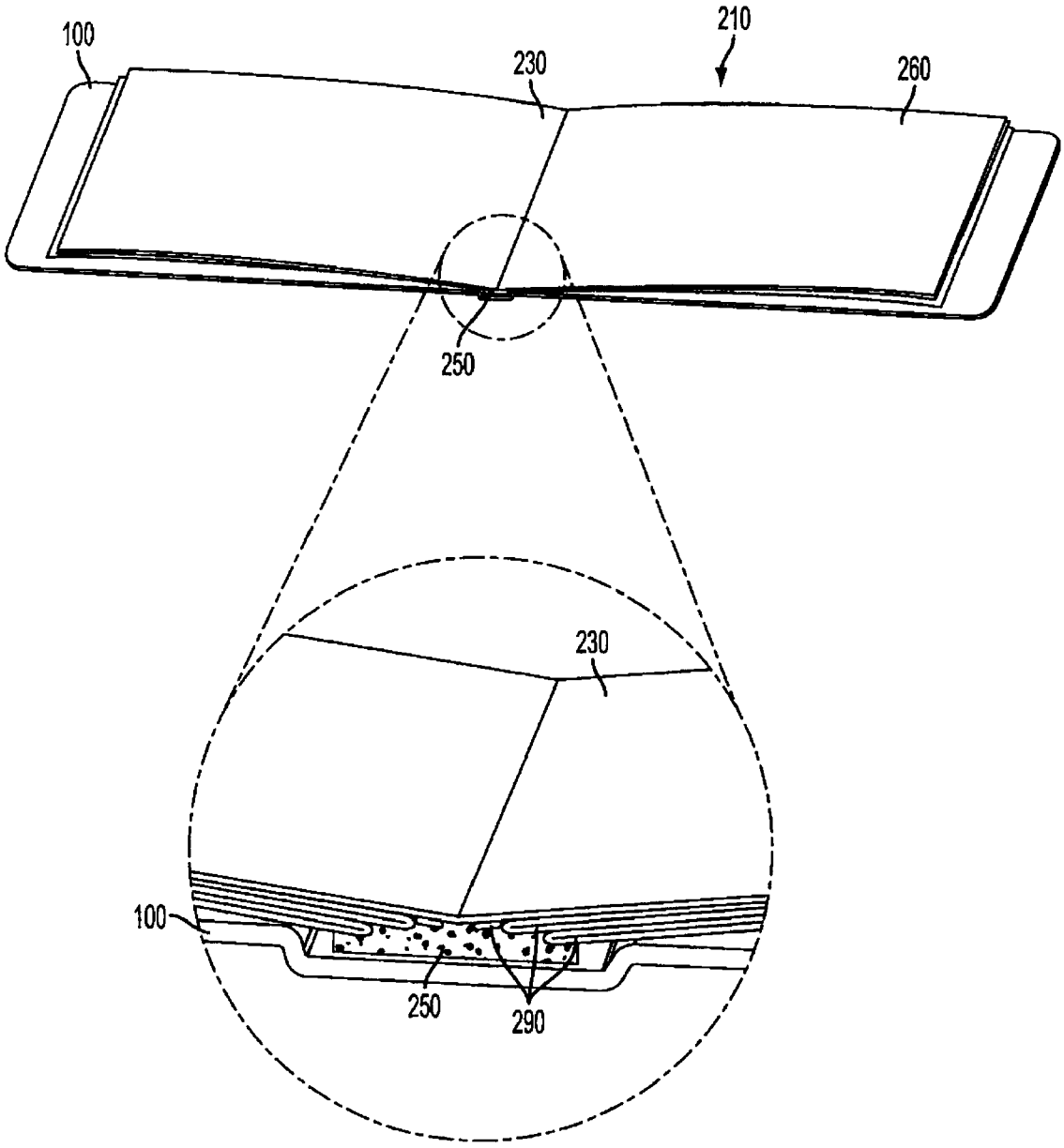
FIG. 16 is a plan view of an opened finished book cover showing the attached media bundle pages opened to form a single viewing plane.

The assembled book can now be used. Any V-fold shaped medium 260 in the book 210 can be seen to create an uninterrupted single page 230 when the edges of the V-fold shaped medium are separated, as shown in FIG. 16. Because there is no stitching, binding, staples, rings, or other penetrating media, and because the media are not clamped into a binding, the V-fold shaped media pages 260, or any two adjacent pages, can be opened to at least 150 degrees from the adjacent media (or other half of the V-folded page), allowing each page to be viewed edge-to-edge. This is ideal for insertion of panoramic images, or decorative sheets or prints that span both sides of a V-fold medium. As can be seen in FIG. 16, the adhesive strip deforms 250 to accommodate the angle of opened pages without letting go of the pages. This deformation is assisted by the adhesive protrusions 290 that occur between the media, holding each medium in place while the adhesive strip flexes to accommodate movement of the medium.

The assembled book does not require page trimming because the pages are not nested. If all media in the bundle is of the same dimensions and aligned before insertion into the book cover, the resulting book pages will be similarly aligned in all dimensions. Intentional use of media of different dimensions is envisioned as well, and will result in uneven edges on at least one side of the media pages, per the user's intent.

The book cover, adhesive strip, or both can be any shape suitable for use. In most cases, the book cover and adhesive strip are both expected to be rectilinear in shape. However, both geometric and asymmetric shapes are envisioned for use as appropriate to the user's intentions for both the book cover and insertion media. For example, an art book may require non-rectilinear shapes of the book cover to achieve the desired artistic effect, for example, where the finished book is meant to open in appearance like a rounded clam shell, or opening flower petals, where the media is at the core. Such shapes of the book cover and insertion media may require asymmetrical or geometrically shaped adhesive strips. Thus, the term "strip" as used in conjunction with "adhesive" or "release" herein is meant to convey a material size that is capable of handling and manipulation by a user, not a particular shape.

The invention has been described with reference to various specific embodiments. However, it will be appreciated that variations and modifications can be effected by a person of ordinary skill in the art without departing from the scope of the invention.

PARTS LIST

10 Assembled "Prior Art" Adhesive Photo Print Binding System
20 Photo Print Binder Cover
30 Flexible Substrate
40 Close-up View of Spine Section
50 Flexible Substrate Underside Adhesive Strip
60 Flexible Spine Crease
62 Spine Crease Indicator(s)
65 Spine Section
70 Photo Prints
80 Pressure Sensitive Adhesive
90 Floating Spine Section
100 Book Cover
110 Gel Adhesive
120 Gel Adhesive Containment Tray
130 Adhesive impregnated Foam Strip
140 Cast Gel Adhesive Strip
150 Media Bundle
160 Release Strip
170 Adhesive Strip with Attached Release Strip
180 Disposable Media Clamp
210 Finished Book
230 Uninterrupted Page View
250 Adhesive Strip Deformed
260 V-Folded Page Set
270 Center Crease
275 Media Portion of Perforated Media
280 Perforations
290 Adhesive Protrusion
300 Coating Material Packet
310 Free Falling Coating Material
320 Adhesive Strip with Coating Material

The invention claimed is:

1. A method of forming a book comprising:

obtaining a book cover having a front cover, a back cover, and a spine section, wherein the spine section includes an adhesive strip, the adhesive strip having a first side contacting the spine section, wherein the adhesive strip has a peak load gram force per inch of at least 200 and a thickness of at least 0.1 mm, and the adhesive strip has at least one release strip removably attached to a second side thereof;

attaching a first portion of a media clamp on an inside surface of the front cover;

attaching a second portion of the media clamp on an inside surface of the back cover;

opening the book cover to expose the adhesive strip and at least one release strip, the at least one release strip contacting the second side of the adhesive strip;

assembling media for insertion into the book;

placing the assembled media against the at least one release strip;

compressing the assembled media using the media clamp by closing the front cover and the back cover against the assembled media;

pulling the at least one release strip to remove it from between the at least one adhesive strip and assembled media; and pressing the assembled media into the adhesive strip.

2. The method of claim 1, further comprising obtaining a coating material and applying the coating material to the adhesive strip.

3. The method of claim 1, further comprising selecting the spine section width, wherein the book cover comprises indicia for multiple spine section widths.

4. The method of claim 3, wherein the spine section indicia are creases, perforations, score marks, or lines.

5. The method of claim 1, wherein the at least one release strip is folded into a V-shape, with a portion of the at least one release strip not adhered to the adhesive strip.

6. The method of claim 1, wherein the at least one release strip is flexible and has a low coefficient of friction of about 0.5 or less.

7. The method of claim 1, wherein the adhesive strip is an adhesive impregnated foam, a gel adhesive, or a cast adhesive.

8. The method of claim 1, wherein the assembled media comprises one or more V-folded material, the V-folded material having a V-fold-shaped edge and two free edges, wherein the V-fold-shaped edge is pressed into the adhesive strip.

9. The method of claim 8, wherein the at least one V-folded material can be opened such that an entire surface between the two free edges can be viewed.

10. The method of claim 1, wherein the step of pulling the at least one release strip to remove it from between the adhesive strip and assembled media is done before placing the assembled media against the adhesive strip.

11. The method of claim 1, wherein assembling media for insertion into the book comprises obtaining a prepared media stack.

12. The method of claim 1, wherein the book can be opened such that two adjacent media can form an angle of at least 150 degrees.

* * * * *